US005519951A

United States Patent [19]

Paris

[11] Patent Number: 5,519,951

[45] Date of Patent: May 28, 1996

[54] ALPINE SKI BOOT HAVING A PIVOTAL REAR COLLAR AND A FRONT COLLAR PIVOTAL ABOUT A TRANSVERSE AXIS LOCATED IN A PARTICULAR ZONE

[75] Inventor: Jean Paris, Sevrier, France

[73] Assignee: Salomon S.A., Metz-Tessy, France

[21] Appl. No.: 396,333

[22] Filed: Feb. 28, 1995

Related U.S. Application Data

[63] Continuation of Ser. No. 32,245, Mar. 17, 1993, abandoned.

[30] Foreign Application Priority Data

Mar. 23, 1992 [FR] France ..... 92 03685

[51] Int. Cl.[6] ..... A43B 5/04; A43B 5/16

[52] U.S. Cl. ..... 36/117; 36/120

[58] Field of Search ..... 36/117, 118, 119, 36/120, 121

[56] References Cited

U.S. PATENT DOCUMENTS

| | | | |
|---|---|---|---|
| 4,231,170 | 11/1980 | Griswold | 36/72 R |
| 4,580,357 | 4/1986 | Martin | 36/118 |
| 4,602,443 | 7/1986 | Spademan | 36/121 X |
| 4,949,480 | 8/1990 | Hercog et al. | 36/119 |
| 5,031,340 | 7/1991 | Hilgarth | 36/117 |
| 5,167,083 | 12/1992 | Walkhoff | 36/117 |
| 5,197,209 | 3/1993 | Rolland et al. | 36/117 |
| 5,216,826 | 6/1993 | Chaigne et al. | 36/121 X |
| 5,249,377 | 10/1993 | Walkhoff | 36/119 |
| 5,272,823 | 12/1993 | Perrissoud | 36/119 |

FOREIGN PATENT DOCUMENTS

| | | | |
|---|---|---|---|
| 0133476 | 2/1985 | European Pat. Off. . | |
| 2425207 | 1/1980 | France | 36/120 |
| 2667224 | 4/1992 | France . | |

*Primary Examiner*—Jimmy G. Foster
*Assistant Examiner*—BethAnne C. Dayoan
*Attorney, Agent, or Firm*—Greenblum & Bernstein

[57] ABSTRACT

A ski boot having a rigid shell base including an overlying upper equipped with a front cuff and rear collar, both these elements pivoting with respect to the shell base, one in the front zone of the boot, the other in the zone of the malleoli, wherein the front cuff at least partially covers the front slitted upper portion of the shell base, from the tibial support zone of the boot by passing through the zone corresponding to the flexion fold to the zone of the foot corresponding to the metatarsus, where it is pivotably mounted with two journal hooks extending vertically from each side of the boot, each of the two journal hooks being connected to the walls of the shell base by a journal axis localized in a zone demarcated, on the one hand, longitudinally by two transverse vertical planes with respect to the plane of the sole of the shell, and on the other hand, by a plane parallel to the plane of the sole and separated from the latter by a distance approximately equal to the distance of the height of the instep with respect to the plane of the sole, and wherein the plane passes through a point located in the flexion fold zone of the boot, and wherein the plane passes through the point corresponding to the head of the first metatarsus.

16 Claims, 4 Drawing Sheets

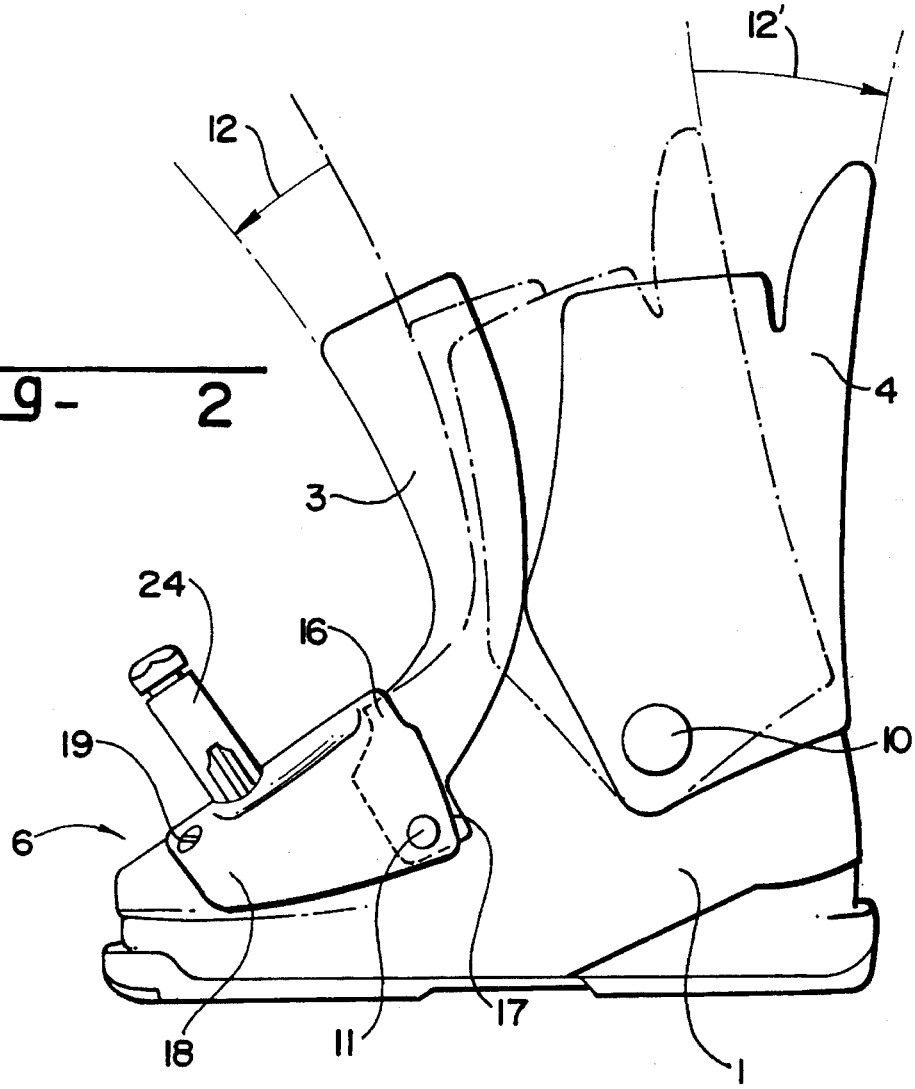
Fig- 2
Fig- 10
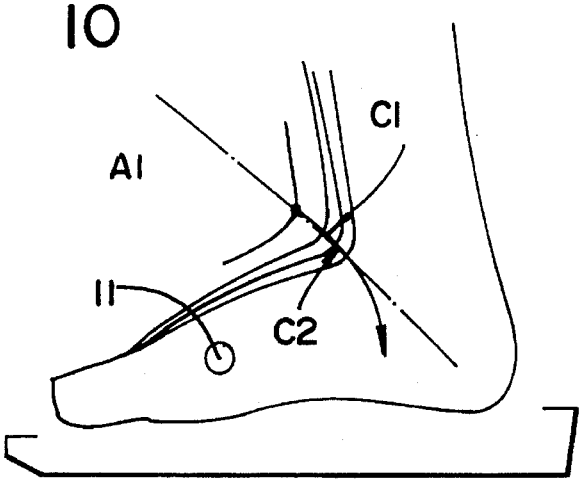

ALPINE SKI BOOT HAVING A PIVOTAL REAR COLLAR AND A FRONT COLLAR PIVOTAL ABOUT A TRANSVERSE AXIS LOCATED IN A PARTICULAR ZONE

CROSS-REFERENCE TO RELATED APPLICATION

This application is a continuation of application Ser. No. 08/032,245, filed on Mar. 17, 1993, now abandoned.

BACKGROUND OF THE INVENTION

1. Field of the Invention

The present invention is related to a ski boot having a rigid or semi-rigid shell with an overlying upper that is constituted, on the one hand, by a rear collar or journalled collar, and on the other hand, by a tongue of a front-foot cuff, covering the front upper zone of the shell.

2. Description of Background and Relevant Information

Ski boots of the aforementioned type are known and must fulfill a variety of functional criteria and, as such, they especially require the use of rigid materials for the construction of their shell, so as to be adapted to instantaneously transmit the impulses from the foot of the skier, and therefore enable precise control during skiing. To this end, the foot and the ankle are generally tightly maintained in the boot by adjustable portions that are more or less flexible and/or anatomical, and are protected from any injury or harm at the level of their joints by rigid portions of the shell and of the upper, journalled with respect to each other and relatively spaced from the adjustable portions. However, although such boots ensure that the ski functions well, they are not always adapted to enable functioning in the resting or walking positions, and this is indispensable to the skier's comfort while accessing and/or waiting at ski lifts in winter sports resorts.

In the French Patent Publication No. 2,667,224, a boot of the aforementioned type has been described and taught by the Applicant. Indeed, in such a boot, a slit extends longitudinally from the upper front end of the shell base to the front edge of the upper where it ends. A front cuff fixed on the tip of the shell base covers the slit and extends to the lower part of the leg where it is connected with a rear collar to ensure closure of the upper. This front cuff extends rearwardly and upwardly by a relatively flexible tongue. In the front zone of the cuff, tightening means of the foot in the shell are arranged, whereas the flexible tongue enables both an adaptation to the configuration of the lower part of the leg, as well as a deformation that is adapted to ensure a spacing of the other portions of the upper, enabling the boot to be put on. This spacing, which is maintained manually by the skier while putting on and removing the boot, is rarely an easy exercise for the user, and handicaps the boot with a certain discomfort of use.

According to another boot structure disclosed in European Patent No. 0 133 476, the skier can use a rear entry type of boot whose upper is constituted by two front and rear portions journalled on a shell base at two different points, and spaced apart in such a way that the upper obtains what is commonly known as a tulip opening. At the moment of closure of the boot, the front upper is folded back rearwardly, so that it covers the lateral edges of the rear upper and encircles the latter by means of a rear closure device. A sort of rigid control rod is located inside the front portion of the upper, the control rod ensuring transmission of forces from the tibia to the instep zone. Such a constructional arrangement clearly shows that the advantage procured by the tulip-type opening of the upper is reduced, on the one hand, by the presence of the control rod which remains in the vicinity of the contour of the lower part of the leg, including when the boot is opened, and on the other hand, by the "blind" closure of the upper that occurs at the rear of the boot.

SUMMARY OF THE INVENTION

The present invention proposes a new ski boot whose upper is constituted by the assembly and cooperation of a journalled rear collar and a front-foot cuff having a special structure.

Indeed, an object of the invention is to obtain the so-called "upper release" ski boots whose front-rear clearance allows the latter to have an amplitude with respect to the shell base, so that the "walking" or "resting position" functions of the boot are ensured without adversely affecting the other usage functions of the boot, i.e., for example, those of foot retention, angulation, advance, etc. Another aim of the invention, applied to boots of the central entry type, consists of overcoming the difficulties commonly encountered while putting on and removing the boot, by virtue of cooperation means of the front cuff with the shell, localized in a specific zone of the shell base.

The boot according to the invention is of the type comprising a rigid or semi-rigid shell base, which is overlaid by an upper equipped at least with a front cuff and a rear collar, both of these elements pivoting on the shell base, one in the front zone of the boot, the other in the zone of the malleoli. The shell base is obtained with an upper longitudinal slit for introduction of the foot demarcated by vertical extensions extending from the rigid sole and constituting the walls of the boot, which, at the level of the malleoli, together with the vertical portions of the front cuff and rear collar, form the upper of the boot. In order to facilitate engagement of the foot, such walls are provided to be relatively deformable and/or flexible so as to closely assume the shape of the foot, especially in the vicinity of their edge demarcating the longitudinal slit of the shell base; for the zone corresponding to the front-foot, for example, the lateral walls can extend until they join and/or overlap at least partially in order to obtain an enveloping of the front-foot. According to the invention, the front cuff at least partially covers the upper front portion of the shell base and especially the slit and its edge, from the zone of the boot corresponding approximately to the metatarsus, where it is mounted rotationally. In order to do this, the front cuff is obtained in one piece in the shape of an incurved channel straddling the slit of the shell base and has, at its lower front portion, two journal hooks extending laterally from each side of the shell base. These journal hooks are each connected to the walls of the shell base by an assembly means constituted by a journal pin or axle having a retention head, making the front cuff cooperate with the shell base in a zone demarcated longitudinally by the vertical axis passing through the flexion fold, on the one hand, and by the vertical axis passing through the first metatarsal zone, on the other hand.

According to a yet another complementary characteristic of the invention, the cooperation zone of the journal hooks of the front cuff of the shell base is demarcated vertically by a horizontal plane, which is parallel and spaced by a dimension corresponding to the height of the instep, measured from the plane of the walking sole. The measurement of the instep is taken at the projecting portion of the top of the foot, corresponding to the front projection of the tarsal bones of the foot. It is at this level that the perimeter of the instep is located, which is one of the elements of measurement and determination of the fitting volume of the foot.

According to another characteristic of the invention, the lateral edges of the front cuff partially cover the walls of the shell base that are adjacent to the longitudinal slit, while they themselves are covered by the flaps of the rear collar in the zone of the upper corresponding to the lower part of the leg of the skier.

BRIEF DESCRIPTION OF THE DRAWINGS

Other characteristics and advantages of the invention will become apparent upon reading the description that follows with reference to the annexed drawings, provided only as non-limiting examples.

FIG. 2 is a top view of the boot of FIG. 1, seen from the inner side, and showing the extreme positions that the component elements of the upper, and especially the front cuff, are capable of espousing with respect to the shell base.

FIG. 10 illustrates, in a schematic manner, one of the characteristics of the invention.

DETAILED DESCRIPTION OF THE PREFERRED EMBODIMENTS

Figure 1:
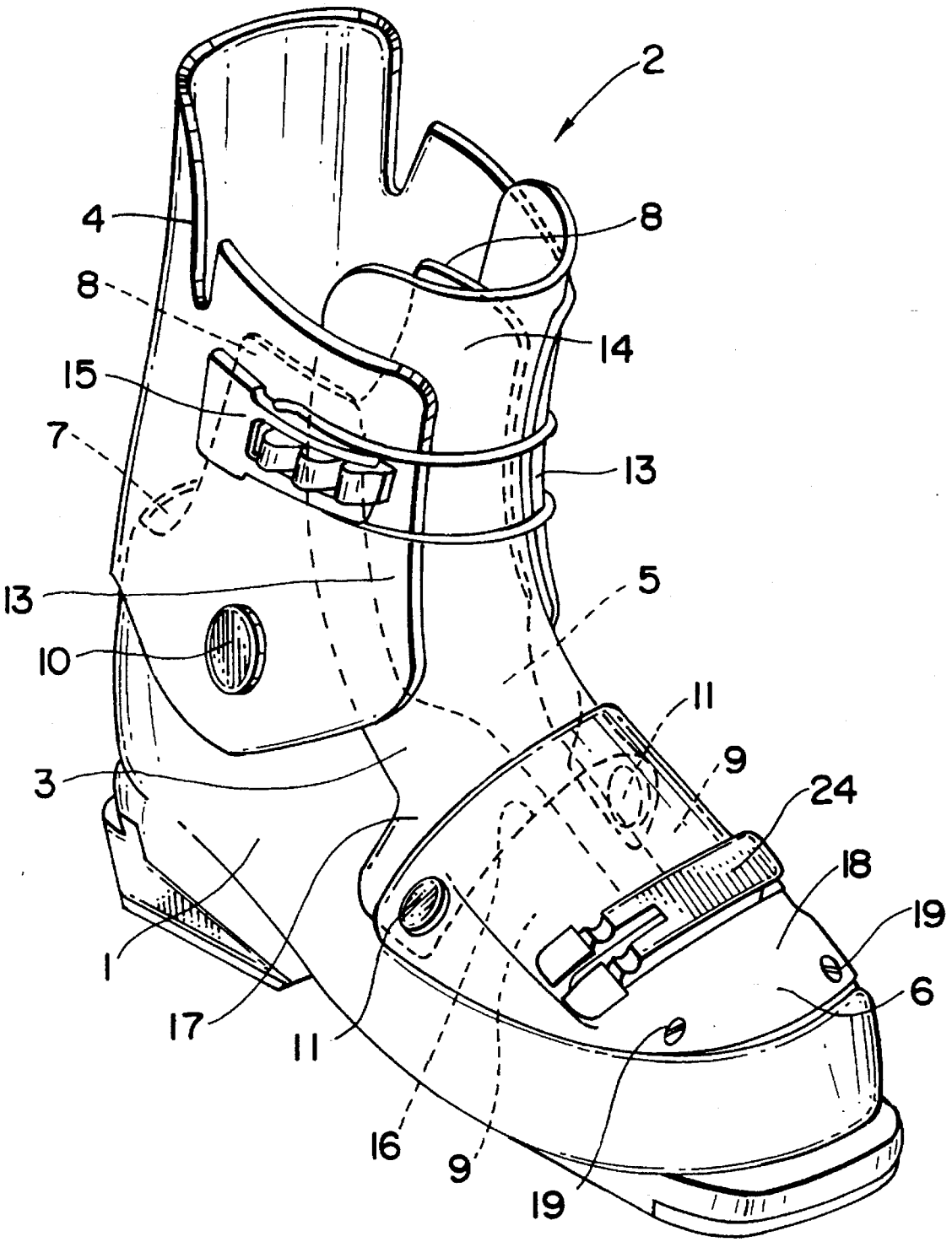
FIG. 1 illustrates, in a perspective view, a ski boot comprising a front cuff according to the invention.
Figure 3:
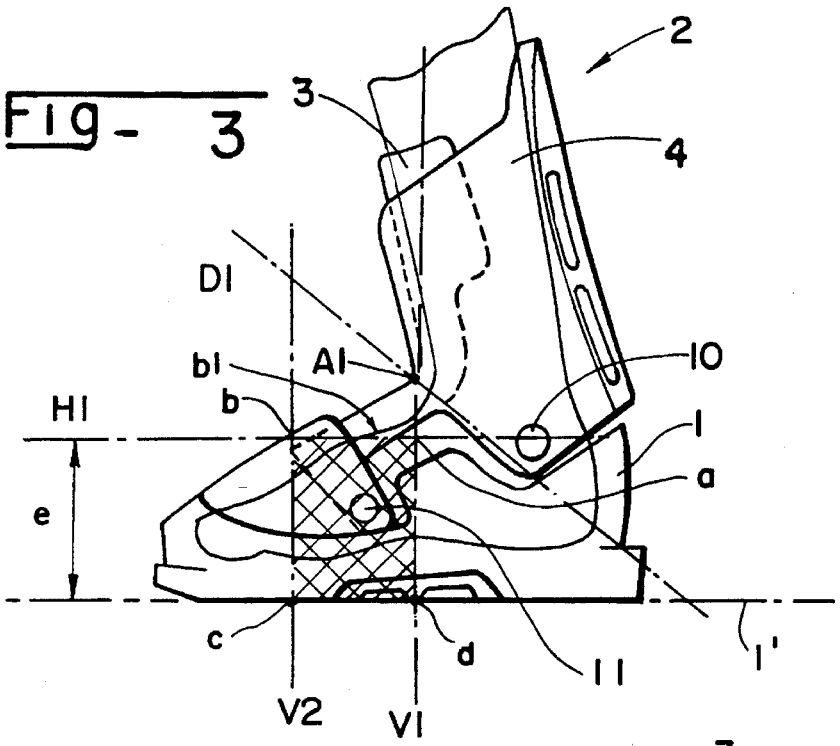
FIG. 3 shows a side view of the boot according to the invention, in which the preferred implantation zone of the journal rivets of the front cuff are indicated.
Figure 4:
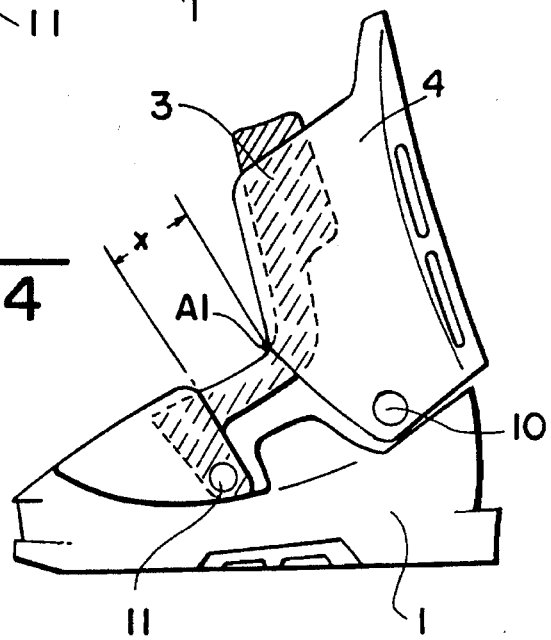
FIGS. 4 and 5 represent the boot according to the invention in a side view, in which are indicated the clearance values of the upper at the level of the flexion fold zone on the front cuff, respectively in a latched position (FIG. 4), then in a released position (FIG. 5).

The ski boot represented in FIGS. 1–5 comprises a rigid shell base (1) on which an upper (2) is journalled, the upper being provided with a front cuff (3) and rear collar (4); the shell base (1) has an upper longitudinal slit (5) for introduction of the foot, the slit extending from the tip (6) of the boot to heel (7). This slit (5) is demarcated, among other things, by vertical extensions (8) in the zone of the malleoli and vertical extensions (9) in the zone of the front-foot, the end of such extensions capable of at least partially overlapping in order to obtain enveloping of the top of the front-foot. In this embodiment of the boot, rear collar (4) is pivotable about shell base (1) in the zone of the malleoli about a transverse horizontal axle (10) and front cuff (3), about attachment points (11) located in a lateral zone of each of vertical extensions (9), defined, as is schematically represented in FIG. 3, on the one hand, by two vertical planes (V1) and (V2) at the plane of the sole, and on the other hand, by a plane (H1) parallel to the plane of the sole. As is illustrated by arrow (12) of FIG. 2, these attachments points (11) then enable a rotation of front cuff (3) with respect to shell base (1), providing an amplitude of opening for putting on and removal of the boot which is increased by the amplitude of rear collar (4), indicated by arrow (12'), thus ensuring an unparalleled ease of use for the skier.

Furthermore, rear collar (4) is obtained with two lateral wings (13) which encircle, on the one hand, vertical extensions (8) of shell base (1), and on the other hand, at least partially, the rear vertical portion (14) of front cuff (3); the rear collar (4) thus constitutes, together with a tightening and closure device (15) of wings (13), the closure collar of upper (2) on the lower part of the leg of the skier. Regarding front cuff (3), such element is obtained in one piece in the shape of an downwardly curved channel straddling slit (5) of shell base (1) by its upper portion (14) on the zone of the lower part of the leg, and by its front portion (16) on the front-foot zone; the latter at least partially covers vertical extensions (9) which form the lateral walls of shell base (1), approximately perpendicularly to the zone extending from the instep to the metatarsus of the foot of the wearer of the boot. To this end, front cuff (3) comprises two lateral extensions (17) which extend downwardly along walls (9). According to the invention, front cuff (3) is connected to such walls by means of its lateral extensions (17) and by attachment devices (11).

FIG. 3 illustrates in greater detail, the manner in which the attachment zone of lateral extensions (17) on shell base (1) is defined. Indeed, the zone represented in FIG. 3 by the planar projection (quadrilateral a, b, c, d) of the curved surface of one portion of each of the sides of shell base (1) is demarcated, on the one hand, by the two planes (V1) and (V2) that are vertical with respect to the plane of the sole, and on the other hand, by a horizontal plane (H1) parallel to plane (1') of the sole and passing through point (b1) corresponding to the top of the instep zone. Point (b1) of the projecting zone of the top of the foot corresponds to the front projection of the tarsal bones of the foot. It is at this level that the perimeter of the instep is located, which is one of the elements for measuring the foot and for determining the fitting volume. Advantageously, this plane (H1) is located at a distance (e) substantially equal to 90 millimeters from the plane (1') of the sole. Plane (V1) passes through point (A1) of the flexion fold of the boot, located at the intersection of the diagonal plane (D1) corresponding to the short perimeter of the heel with the curve of the top of the front cuff (3), whereas plane (V2) passes through point (b) corresponding to the top zone of the first metatarsus.

Figure 5:
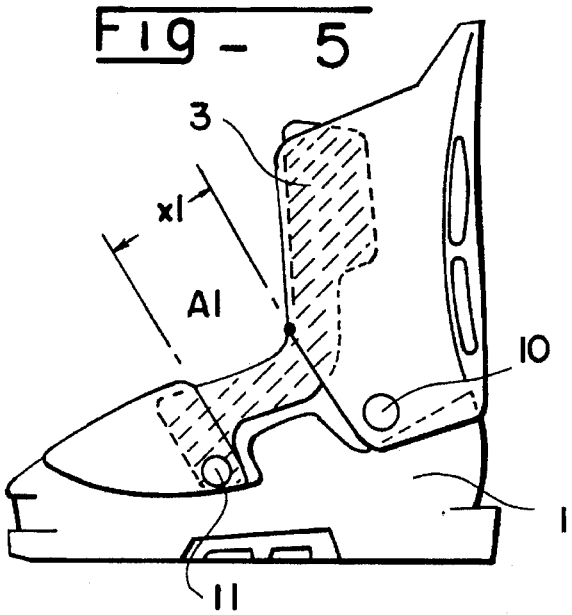

Thus, journal (11) of front cuff (3) located in the zone (a, b, c, d) enables the definition and determination of the direction and amplitude of displacement of point (A1) (flexion fold zone), influencing the quality of release of the upper from its skiing position (reference "x" of FIG. 4) to its so-called walking position (reference "$x_1$" of FIG. 5). Further, the front end of the front cuff (3), or at least a portion thereof through which the journal (11) extends, is also located in the aforementioned zone.

In the case of the boot according to the invention illustrated in FIGS. 1–5, front cuff (3) is covered in its front zone (16), by a front-foot cover (18) fixed to the shell base by assembly means (19) localized in the zone of tip (6) of the boot, and laterally by means of attachment points (11) acting simultaneously as journal axis for front cuff (3).

Figure 6:
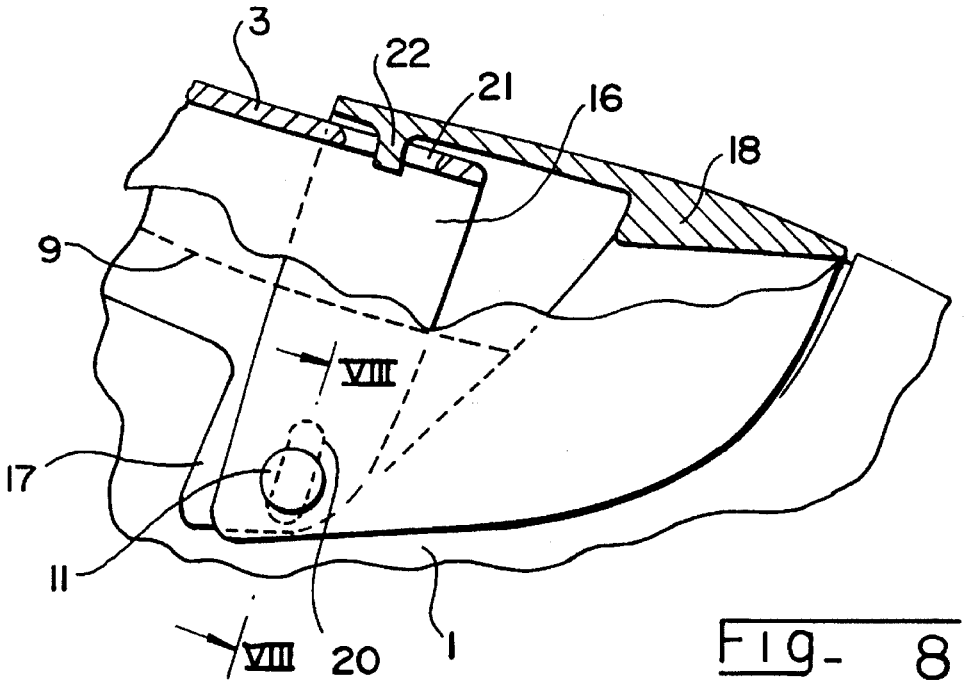
FIG. 6 illustrates in a longitudinal partial sectional view, the detail of the assembly of the front cuff on the shell base in the case of a boot, as per the invention, provided with a front-foot cover.

FIG. 6 illustrates the constructional and assembly detail obtained between front cuff (3) and front-foot cover (18). In this embodiment, cover (18) is allowed to be lifted slightly rearwardly at the moment of opening of the upper, so as to facilitate even more the introduction and/or extraction of the foot from the boot. Indeed, journal axle (11) has the possibility of being displaced along an oblong slot (20) arranged in the shell base, as can be seen in FIG. 8 representing this constructional arrangement in a partial sectional view.

According to the variation represented in FIG. 6, front cuff (3) can be provided in its front zone (16) with a guide slit (21) in which a lug (22) originating from cover (18) slides, which, when associated with a cover (18) capable of being lifted during opening, improve thus the rotation of front cuff (3). The advantage of the front-foot cover resides in the fact that this type of construction enables the addition of an internal tightening means (24) of the front-foot, pre-mounted on the cover before assembly of the latter on the shell base. Since this tightening means (24) was the object of a patent application by the Applicant, it will not be described in greater detail.

Figure 7:
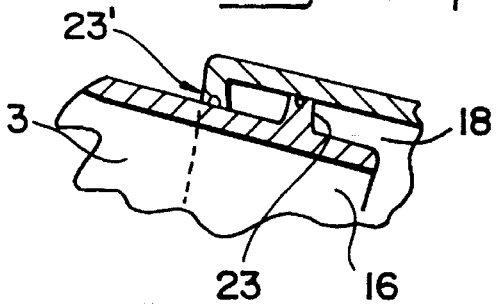

FIG. 7, represents, in a partial sectional view, a boot structure where front cuff (3) is simply covered by cover (18), each of the two present elements being provided with sealing means (23, 23') of the "lip joint" type.

Figure 8:
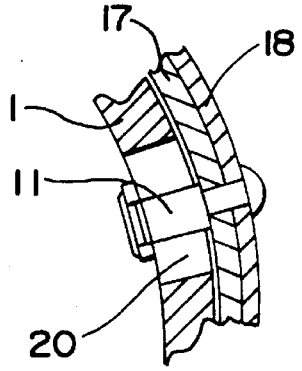
FIGS. 7, 8 and 9 illustrate in partial sectional views, details of variations of the construction, respectively at the level of the overlapping zone between the front cuff and front-foot cover (FIG. 7), at the level of the journal means of the front cuff where the shell base is provided with a front-foot cover (FIGS. 8 and 9).
Figure 9:
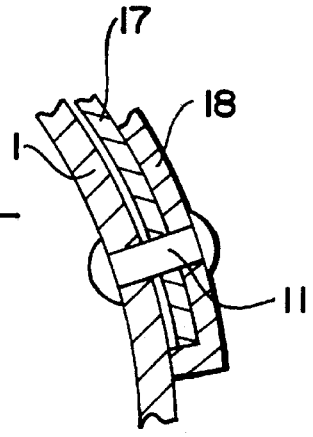

FIG. 9 shows another constructional variation in which journal axle (11), which acts both as the lateral attachment point to cover (18) and as a journal to the front cuff, does not allow any lifting movement to the front-foot cover, thus constituting a less sophisticated version of FIG. 8. The journal axles (11) can be considered to comprise an articulated connection between the front portion of the front cuff and the rear portion of the front foot cover.

The boot according to the invention is not limited to the example represented and described hereinabove, and a person of the art can easily obtain a boot whose front-foot cover forms an integral part of shell base (1). Similarly, front cuff (3) may be journalled on shell base (1), such that it is the cuff (3) that straddles the surface of the shell base, it being understood that known sealing means must be interposed between the two portions of the boot in the zone corresponding to front zone (16) of the front cuff (3).

It is understood that one would not be outside the scope of the invention if the front-foot cover (18) formed an integral part of shell base (1). Indeed, the front-foot cover (18) can be molded with shell base (1) so as to form a single and same element.

FIG. 10 illustrates the advantage obtained by the position of journals (11), which is such that the displacement of point (A1) is a path (C1) corresponding substantially to point (C2) of the different flexion folds for different individuals having the same boot size.

The instant application is based upon French patent application 92.03685, of Mar. 23, 1992, the disclosure of which is hereby expressly incorporated by reference thereto, and the priority of which is hereby claimed.

Naturally, the invention is not limited to the embodiments described and represented hereinabove, but also comprises all technical equivalents and combinations thereof.

What is claimed is:

1. A ski boot for receiving a foot of a skier, the foot including a malleoli, a metatarsus area and a heel, the metatarsus area including a first metatarsus, the heel having a short peripheral area, said ski boot comprising:

(a) a rigid shell base having a slot upwardly open and longitudinally extending rearwardly and upwardly from the metatarsus area, through a flexion fold area of the ski boot, to a tibial support area of the ski boot, said slot defining opposite lateral sides of said shell base, said shell base having a sole;

(b) an upper overlying said shell base, said upper comprising:

(i) a rear collar and means for mounting said rear collar to said shell base for rotational movement about an area of the malleoli of the foot of the skier;

(ii) a front cuff and means for mounting said front cuff to said shell base for opening rotational movement and closing rotational movement about a transverse axis at a front area of the ski boot;

(1) said front cuff having a flexion fold area;

(2) said means for mounting said front cuff comprising a journal axle extending from each opposite lateral side of said shell base, said journal axles defining said transverse axis about which said front cuff is rotatable;

(3) said transverse axis being located in a zone defined by a pair of substantially horizontal planes and a pair of substantially vertical planes;

(A) said pair of substantially horizontal planes comprising a first substantially horizontal plane defined by the sole of the ski boot and a second substantially horizontal plane substantially parallel to the first horizontal plane and positioned above the first horizontal plane substantially at a position corresponding to the skier's instep;

(B) said pair of substantially vertical planes comprising a first substantially vertical plane passing through a predetermined point in said flexion fold area of said front cuff and a second substantially vertical plane passing through a forward portion of the first metatarsus and forwardly spaced from the first vertical plane; and (iii) a front foot cover mounted upon a front portion of said shell base and extending forwardly of said front cuff, said means for mounting said front cuff to said shell base comprising means for mounting said front cuff for said opening rotational movement and said closing rotational movement with respect to said front foot cover.

2. The ski boot according to claim 1, wherein said predetermined point in said flexion fold area of said front cuff corresponds to a point of intersection between an upper surface of said front cuff in said flexion fold area and a diagonal plane passing through said short peripheral area of the heel of the skier.

3. The ski boot according to claim 1, wherein said front cuff further comprises a rear upwardly extending portion, rearwardly and upwardly extending from said flexion fold area, and wherein said rear collar at least partially overlaps said rear upwardly extending portion of said front cuff.

4. The ski boot according to claim 1, wherein said front foot cover is positioned over a front end portion of said front cuff.

5. The ski boot according to claim 4, wherein said front foot cover is connected to said shell base by means of said journal axles mounting said front cuff to said shell base, said front cuff having a front portion and said front foot cover having a rear portion, wherein said journal axles comprise an articulated connection between said front portion of said front cuff and said rear portion of said front foot cover.

6. The ski boot according to claim 4, further comprising means for mounting said journal axles for movement along respective generally upwardly directed paths with respect to said shell base and means for enabling said front foot cover to be driven upwardly during an opening rotation of said upper.

7. The ski boot according to claim 4, wherein said front foot cover is unitary with said shell base.

8. The ski boot according to claim 1, wherein said front cuff consists of a single piece of material defining a downwardly open longitudinally extending channel overlying said slot of said shell base, and wherein said journal axles connect said front cuff to said shell base at opposite lateral sides of said front cuff at a lower end portion of said front cuff.

9. The ski boot according to claim 1, wherein the second substantially horizontal plane is spaced from the first substantially horizontal plane by a distance of approximately 90 millimeters.

10. A ski boot for receiving a foot of a skier, the foot including a malleoli, a first metatarsus and a heel, the heel having a short peripheral area, said ski boot comprising:

(a) a shell base having an upwardly open slot longitudinally extending rearwardly and upwardly from a metatarsus area, through a flexion fold area, to a tibial support area of the ski boot, said slot defining opposite lateral sides of said shell base, said shell base having a sole;

(b) an upper overlying said shell base, said upper comprising:

(i) a rear collar and means for mounting said rear collar to said shell base for rotational movement about an area of the malleoli of the foot of the skier;

(ii) a front cuff and a journal axle extending from each opposite lateral side of said shell base, said journal axles defining a transverse axis about which said front cuff is rotatable with respect to said shell base for opening rotational movement and closing rotational movement about the transverse axis, said front cuff having a flexion fold area, said front cuff consisting of a single piece of material constituting a downwardly open and longitudinally extending channel overlying said slot of said shell base, and wherein said journal axles connect said front cuff to said shell base at opposite lateral sides of said front cuff at a lower end portion of said front cuff, said transverse axis being located in a zone defined by a first pair of substantially parallel planes and a second pair of substantially parallel planes;

said first pair of substantially parallel planes comprising a first plane defined by the sole of the ski boot and a plane positioned above the first plane substantially at a position corresponding to the skier's instep;

said second pair of substantially parallel planes comprising a third plane passing through a predetermined point in said flexion fold area of said front cuff and a fourth plane passing through a forward end of the first metatarsus and forwardly spaced from the third plane (iii) a front foot cover mounted upon a front portion of said shell base and extending forwardly of said front cuff, said means for mounting said front cuff to said shell base comprising means for mounting said front cuff for said opening rotational movement and said closing rotational movement with respect to said front foot cover.

11. The ski boot according to claim 10, further comprising a front foot cover mounted upon a front upwardly facing portion of said shell base, said front foot cover being positioned over a front end portion of said front cuff.

12. The ski boot according to claim 11, wherein said front foot cover is connected to said shell base by means of said journal axles mounting said front cuff to said shell base, said front cuff having a front portion and said front foot cover having a rear portion, wherein said journal axles comprise an articulated connection between said front portion of said front cuff and said rear portion of said front foot cover.

13. The ski boot according to claim 12, wherein said front foot cover includes a rear end portion overlapping a forward end portion of said front cuff.

14. The ski boot according to claim 1, wherein said front cuff comprises a front end and wherein at least a portion of said front end of said front cuff is located within said zone.

15. The ski boot according to claim 10, wherein said front cuff comprises a front end and wherein at least a portion of said front end of said front cuff is located within said zone.

16. A ski boot for receiving a foot of a skier, the foot including a malleoli, a metatarsus and a heel, the metatarsus area including a first metatarsus, the heel having a short peripheral area, said ski boot comprising:

(a) a rigid shell base having a slot upwardly open and longitudinally extending rearwardly and upwardly from the metatarsus area, through a flexion fold area of the ski boot, to a tibial support area of the ski boot, said slot defining opposite lateral sides of said shell base, said shell base having a sole;

(b) an upper overlying said shell base, said upper comprising:

(i) a rear collar and means for mounting said rear collar to said shell base for rotational movement of said rear collar about an area of the malleoli of the foot of the skier; and (ii) a front cuff and means for mounting said front cuff to said shell base for journalled movement in a forward direction for opening said upper and for journalled movement in a rearward direction for closing said upper, said journalled movement in a forward direction and said journalled movement in a rearward direction comprising journalled movement about a transverse axis at a predeterminate zone of the ski boot, said journalled movement for opening said upper and said journalled movement for closing said upper being confined to said predeterminate zone;

(1) said front cuff having a flexion fold area;

(2) said means for mounting said front cuff comprising a journal axle extending from each opposite lateral side of said shell base, said journal axles defining said transverse axis about which said front cuff is movable;

(3) said transverse axis being located in said predeterminate zone, said predeterminate zone being defined by a pair of substantially horizontal planes and a pair of substantially vertical planes;

(A) said pair of substantially horizontal planes comprising a first substantially horizontal plane defined by the sole of the ski boot and a second substantially horizontal plane substantially parallel to the first horizontal plane and positioned above the first horizontal plane substantially at a position corresponding to the skier's instep;

(B) said pair of substantially vertical planes comprising a first substantially vertical plane passing through a predetermined point in said flexion fold area of said front cuff and a second substantially vertical plane passing through a forward portion of the first metatarsus and forwardly spaced from the first vertical plane.

* * * * *